United States Patent [19]

Doak

[11] 3,937,168

[45] Feb. 10, 1976

[54] BILGE PUMP

[76] Inventor: Lyle E. Doak, 30 E. Golden Lake Road, Circle Pines, Minn. 55014

[22] Filed: Mar. 17, 1975

[21] Appl. No.: 558,914

[52] U.S. Cl. ..... 114/183 A; 417/100; 417/211; 417/240; 137/527.8

[51] Int. Cl.[2] ..... B63B 13/00; B63B 29/16; B63B 37/00; F04F 11/00

[58] Field of Search ..... 417/100, 211, 330, 240, 417/241; 114/183 A, 183 R, 184, 185

[56] References Cited

UNITED STATES PATENTS

| | | | |
|---|---|---|---|
| 1,005,616 | 10/1911 | Doose | 417/100 |
| 2,674,948 | 4/1954 | Roof | 114/185 X |
| 3,191,538 | 6/1965 | Adams | 114/183 A X |
| 3,289,592 | 12/1966 | Franzreb | 114/183 A X |
| 3,771,920 | 11/1973 | Grant | 417/211 |

FOREIGN PATENTS OR APPLICATIONS

| | | | |
|---|---|---|---|
| 460,467 | 11/1950 | Italy | 417/330 |

*Primary Examiner*—C. J. Husar
*Assistant Examiner*—Richard E. Gluck
*Attorney, Agent, or Firm*—James R. Haller; H. Dale Palmatier

[57] ABSTRACT

A wave-actuated bilge pump for pumping foul bilge gases from a boat. The pump includes a generally inverted U-shaped section of hollow tubing with generally downwardly directed legs having open ends. One of the ends is positioned to receive bilge gases from within the boat, and the other end is immersed below the surface of the water outside the boat. A freely-opening check valve permits bilge gases to flow within the tubing only away from the fume-receiving end. A gas-escape port opened to the atmosphere is provided in the tubing above the lower, open tubing end immersed in the water, and a second, freely-opening check valve is provided to permit flow of bilge fumes through the port only outwardly of the tubing of the atmosphere. Wave-action causes the level of water in the exterior leg of the tubing to rise and to fall such that bilge gases are drawn into the tubing as the water level falls, and the gases are exhausted from the tubing as the water level rises.

8 Claims, 3 Drawing Figures

BILGE PUMP

BACKGROUND OF THE INVENTION

The collection of foul-smelling and often flammable bilge gases in boats presents a health and safety hazard. Boats often are equipped with electrically powered bilge pumps for the purpose of clearing the boat of explosive gases before an in-board engine is started. If a pilot does not remember to run the bilge pump prior to starting the motor, an explosion and fire may result. One effort to avoid this problem is described in U.S. Pat. No. 3,771,920 in which inflatable plastic bags are provided within liquid-containing compartments in a boat, the rocking of the boat (often absent in heavy, stable craft) serving to alternately inflate and deflate the bags to cause bilge gases to eventually be exhausted from the boat. This device would appear to be expensive, rather heavy and awkward to manage, and difficult to install, and the volume of bilge gases which are exhausted would appear to depend upon the volume of the plastic bags. Much to be desired is a lightweight, simple, inexpensive, easily installed and continuously operating bilge pump which does not depend for its operation upon electric power nor upon rocking of a boat.

BRIEF SUMMARY OF THE INVENTION

The present invention provides a simple, lightweight, easily installed bilge pump for pumping foul and often explosive bilge gases from a boat. The pump comprises a generally inverted U-shaped section of hollow tubing providing a first leg to be mounted on the interior of a boat and having a lower open end for receiving bilge gases, and a second leg to be positioned exteriorly of the boat and having a lower open end immerseable in water outside the boat, the water level in the second leg rising and falling in response to waves or wavelets which temporarily change the water level with respect to the boat. The tubing is provided with an exhaust port open to the atmosphere and spaced above the lower open end of the second leg. Freely-opening check valve means are provided to permit bilge gases to pass only upwardly within the interior leg of the tubing as the water level within the second leg decreases, and to permit exhaust gases to pass outwardly of the port as the water level in the second leg increases. Desirably, at least that portion of the second leg which is immersed in the water is of much greater diameter than the first leg, whereby small changes in the water level in the second leg give rise to significantly large volumetric flow of bilge gases upwardly in the interior leg and through the exhaust port.

DETAILED DESCRIPTION OF THE PREFERRED EMBODIMENT

Figure 1:
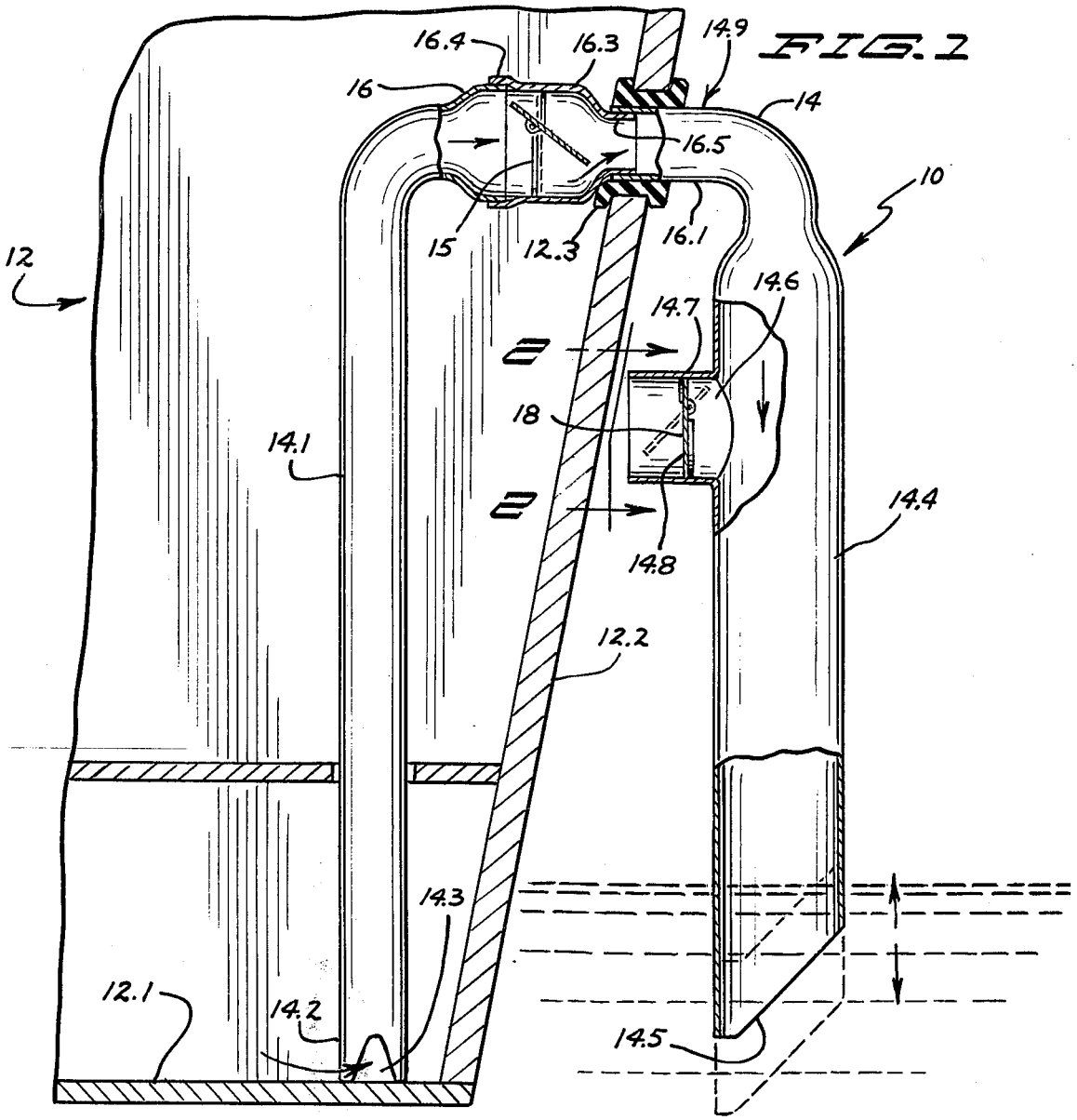
FIG. 1 is a side view, in partial cross section, of the pump of the invention as installed in a boat.

Referring first to FIG. 1, the bilge pump of the invention is designated generally 10 and is shown mounted to a boat 12, the boat having a botton 12.1 and side walls depicted in the drawing as transom 12.2. The pump includes a generally inverted U-shaped length of hollow tubing 14 which is mounted to the boat, as will be subsequently described. The first, or interior leg 14.1 of the section of tubing is provided with a lower, open end 14.2 positioned in close proximity to the boat bottom 12.1 so as to receive bilge gases from the boat. The end 14.2 may be provided with a groove, or notch 14.3 so as to permit bilge gases to enter even though the end 14.2 may be in contact with the bottom of the boat.

The other leg 14.4 of the tubing is carried exteriorly of the boat and has a lower open end 14.5 which is ordinarily submerged a short distance below the surface of the water outside the boat. The diameter of the leg 14.4 is preferably considerably greater than that of the leg 14.1, as will be explained below. Spaced from its lower end 14.5, the exterior leg 14.4 of the tubing section is provided with an exhaust port 14.6 to which is mounted an exterior exhaust duct 14.7 leading to the atmosphere. Within the exhaust duct 14.7 is carried a check valve 14.8 which permits bilge gases to be exhausted through the port to the atmosphere but which prevents air from entering the tubing.

In the cross member 14.9 of the tubing there is positioned another check valve 15 which permits bilge gases to flow upwardly through the interior leg 14.1 and through the valve, but which prevents air or other gases from passing downwardly through the leg 14.1 into the boat.

The leg 14.1 may be made of a section of round, preferably high impact strength plastic tubing. The upper end of the leg 14.1 has a gradual 90° bend, and terminates in a bell-shaped end 16, as shown in FIG. 1. The second, or exterior leg 14.4 of the tubing section 14 is similarly fashioned with a 90° bend at its upper end 16.1, the latter end being of somewhat smaller diameter than the balance of the leg 14.4. The end 16.1 passes through the transom 12.2 or side wall of the boat 12, and a gasket or seal 12.3 may be employed to make the union between the transom and tubing watertight.

A length of connector tubing 16.3 is interfitted between the upper, bent over ends 16 and 16.1 of the interior and exterior legs. One end 16.4 of the connector tubing is flared so as to interfit tightly with the bell-shaped end of the interior leg, and the other end 16.5 of the connector tubing sealingly interfits with the bent over end 16.1 of the exterior tubing leg. In this manner, the pump of the invention may easily be installed through the transom or side wall of the boat by passing the bent over length 16.1 of the exterior tubing leg through the seal 12.3 of the transom, and then connecting the tubing sections 14.1 and 16.3 from within the boat to the exterior leg 14.4.

Figure 2:
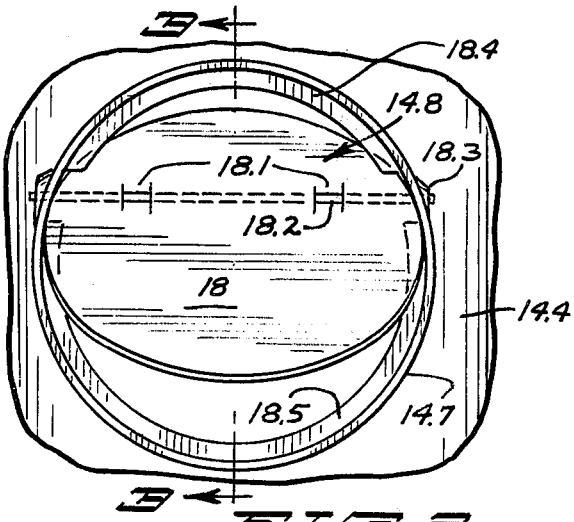
FIG. 2 is a view taken along line 2—2 of FIG. 1 and showing the interior of an easily opening check valve in the exhaust port of the bilge pump.
Figure 3:
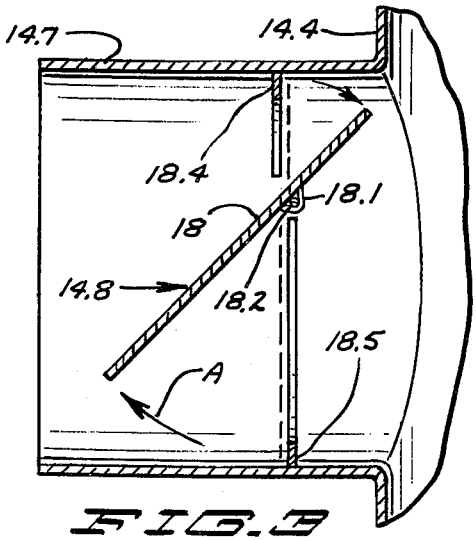
FIG. 3 is a cross-sectional view taken along line 3—3 of FIG. 2.

The check valve 14.6 which is installed in the exhaust duct 14.7 is designed to open when only a very small pressure differential is applied thereacross. The duct 14.7 is itself preferably of round cross section, and the valve 14.8 comprises a lightweight circular disc 18 having a diameter only very slightly less than that of the duct 14.7. On one face, slightly above its center of gravity, the disc 18 is provided with ears 18.1 (which may be formed by slotting and forming the disc as shown in FIG. 2), and a pivot pin 18.2 passes freely through the ears 18.1 and has ends journaled into the side walls of the duct 14.7. Plastic bushings 18.3 may be employed to hold the pivot pin ends in position, as shown best in FIG. 2. Substantially semicircular upper and lower valve seats 18.4, 18.5 are provided around the upper and lower inner peripheries of the duct as shown best in FIG. 3 so that when the disc 18 shuts in the direction opposite to that shown by arrow A, the upper periphery of the disc comes into sealing contact with the seat 18.4, and the lower periphery of the disc comes into contact with the seat 18.5. The position of the pivot pin 18.2 with respect to the disc is so chosen that the lower portion of the disc is slightly heavier than the upper portion so that the disc will close when no pressure differential is applied across the valve. The area of the disc below the pin 18.2 is slightly greater than that of the disc above the pin, and as a result, when the pressure within the leg 14.4 very slightly exceeds atmospheric pressure, the valve will open in the direction shown by arrow A in FIG. 3. On the other hand, when atmospheric pressure is very slightly greater than the pressure within the exterior leg 14.4 of the pump, the pressure of air acting against the lower area of the disc 18 will cause the disc to seal against the valve seats 18.4, 18.5, thereby closing the duct. For proper operation of the pump of the invention, it is desired that the valve 14.8 open when only very slight pressure differentials are created across the valve. For this reason, the diameter of the duct 14.7 is relatively large in comparison to the diameter of, for example, the interior tubing leg 14.1, so as to increase the area over which any pressure differential across the valve may act.

The check valve 15 may be identical in size, structure and function to the valve 14.8, and for this reason the connector tubing section 16.3 encompassing the valve 15 is of relatively large diameter in comparison, for example, to the diameter of the internal tubing leg 14.1. It will be understood that the valve 15 will open when the pressure of bilge gases within the tubing leg 14.1 very slightly exceeds the pressure within the exterior tubing leg 14.4, the disc of the valve 15 opening into the position shown in FIG. 1.

As noted above, the diameter of the tubing leg 14.4 is desirably much greater than that of the interior leg 14.1. The large diameter of the leg 14.4 permits even a small change in the water level within that leg to give rise to a rather large change in the volume of that leg, which change must be compensated for by passage of bilge gases into the tubing leg 14.1. For example, doubling the diameter of the tubing leg 14.4 results in a fourfold increase in volume change within that leg corresponding to a given change in the water level and this in turn causes a fourfold increase in the volume of bilge gases which are drawn into the interior tubing leg 14.1 for eventual exhaustion. It will be understood that the entire length of the exterior leg 14.4 need not be of great diameter; only that section of the leg 14.4 within which the water level varies under normal conditions need be of large diameter.

The pump of the invention is installed in the boat, as mentioned above, by inserting the bent over upper end 16.1 of the exterior tubing leg into the seal 12.3 surrounding an opening in the transom or side wall of the boat. The interior leg 14.1 may then be coupled through the connector section 16.3 to the exterior tubing leg, as depicted in FIG. 1. If desired, a rigid brace (not shown) may be employed to rigidly support the exterior leg 14.4 with respect to the boat.

In operation, waves or wavelets in the body of water supporting the boat continually change, if even by a very small amount, the level of water within the exterior leg 14.4 of the pump. As the water level decreases, the water-free volume of the leg 14.4 becomes greater and the pressure within that leg decreases very slightly. A resulting very small differential applied across the check valve 15 causes this valve to open, and bilge gases accordingly pass through the lower open end 14.2 of the internal legs 14.1 so as to equalize the pressure between the leg 14.1 and 14.4. As the water level within the external leg thereafter increases, the pressure within that leg also increases slightly. The resulting pressure differential across the valve 15 causes that valve to close. The resulting pressure differential which is also applied across the valve 14.8 causes the latter valve to open, allowing the bilge gases under slightly greater pressure to pass outwardly to the atmosphere through the duct 14.7.

Because of the sensitivity of the check valves 14.8 and 15 to even small pressure differentials, the bilge pump of the present invention is useful in exhausting bilge gases even when the body of water in which the boat is moored is quite calm.

The bilge pump of the invention preferably is made of high impact plastic, and it will be understood that the entire pump has but two moving parts (the check valves). The pump takes up little space on either the inside or outside of the boat, and is substantially foolproof and indestructible under normal oprating conditions. If desired, the lower open end 14.5 of the tubing leg 14.4 may be beveled as shown in FIG. 1 so that the trailing edge of that open end is raised above the leading edge thereof, resulting in a sunction or siphon effect when the boat moves forwardly through the water.

I desire to use the bilge pump of my invention in conjunction with a powered, conventional bilge pump, the bilge pump of my invention maintaining the boat reasonably free of bilge gases when the boat is at rest at a mooring.

While I have described a preferred embodiment of the present invention, it should be understood that various changes, adaptations, and modification may be made therein without departing from the spirit of the invention and the scope of the appended claims.

What is claimed:

1. A bilge pump for pumping bilge gases from a boat and comprising a generally inverted U-shaped length of tubing providing a first leg having an open end for receiving bilge gases from a boat and a second leg having a lower, open end immersable in the water outside the boat, the tubing including an exhaust port spaced above the immersed tubing end, and freely-opening check valve means permitting the flow of bilge gases in the first leg only away from the gas-receiving end when water is receding from the second leg and also permitting the flow of bilge gases through the exhaust port outwardly of the tubing to the atmosphere when water is entering the second leg.

2. The bilge pump of cllaim 1 in which the pump is configured for rigid mounting to a boat with the first leg interior of the boat and in communication with bilge gases and with the second leg exterior of the boat, and with a section of connector tubing joining the first and second legs.

3. The bilge pump of claim 1 wherein the valve means comprises a pair of freely-openable check valves, one valve being postioned in the tubing to permit the flow of bilge gases in the first leg only away from the gas-receiving end thereof, and the other valve being positioned at the exhaust port to permit the flow of bilge gases through the exhaust port only outwardly to the atmosphere.

4. The bilge pump of claim 1 in which the valve means comprises a pair of freely-opening check valves, each valve having a valve disc and a split annullar seat against which the periphery of the disc bears, each valve being openable under minute pressure differentials thereacross.

5. The bilge pump of claim 4 in which each valve has a pivot pin pivotally mounting the disc slightly above the center of gravity of the disc so as to cause the latter to close on the valve seat under its own weight in the absence of a pressure differential across the valve.

6. The bilge pump of claim 1 in which the cross-sectional area of at least the lower portion of the second leg is substantially greater than the cross-sectional area of the first leg, whereby a small decrease in water level in the second leg gives rise to a relatively large volumetric flow of bilge gases through the first leg.

7. The bilge pump of claim 6 in which the cross-sectional area of at least the lower portion of the second leg is at least two times greater than the cross-sectional area of the first leg.

8. A bilge pump for pumping bilge gases from a boat and comprising a first generally upright length of tubing having an open lower end to receive bilge gases within the boat, a second substantially upright length of tubing positioned exteriorly of the boat and having a lower open end positioned beneath the surface of water outside the boat, at least the lower portion of the last-mentioned tubing having a cross-sectional area at least two times that of the first length of tubing, a length of connector tubing joining the upper ends of the first and second lengths of tubing, the second length of tubing having adjacent its upper end an exhaust port, an exhaust duct connected to the exhaust port and leading to the atmosphere, and a pair of check valves positioned respectively in the exhaust duct and the length of connector tubing with the last-mentioned tubing and duct forming valve housings for the valves, each valve comprising a disc having a diameter slightly smaller than that of its housing and having a pivot pin pivotally mounting the disc slightly above its center of gravity to opposed housing walls so that the valve will open upon application of a minute pressure differential thereacross, the valve including a split annular valve seat carried by the inner walls of the housing and arranged to engage the periphery of the disc as the latter assumes a position perpendicular to the flow direction of bilge gases through the housing, whereby the slight vacuum created in the tubing exterior of the boat as the water level therein decreases causes the valve in the connector tubing to open so that bilge gases flow into the exterior length of tubing from the interior length of tubing, and whereby a subsequent increase in the water level in the exterior length of tubing increases the pressure of bilge gases therein causing the check valve in the exhaust duct to open, whereby the bilge gases are exhausted from the pump.

* * * * *